US011135833B2

(12) United States Patent
Schmidt

(10) Patent No.: US 11,135,833 B2
(45) Date of Patent: Oct. 5, 2021

(54) METHOD FOR VERIFYING A PRINTING PLATE, SPECIFICALLY A GRAVURE CYLINDER

(71) Applicant: MATTHEWS INTERNATIONAL GMBH, Duisburg (DE)

(72) Inventor: Daniel Schmidt, Ahaus (DE)

(73) Assignee: MATTHEWS INTERNATIONAL GmbH

( * ) Notice: Subject to any disclaimer, the term of this patent is extended or adjusted under 35 U.S.C. 154(b) by 489 days.

(21) Appl. No.: 16/078,167

(22) PCT Filed: Jan. 17, 2018

(86) PCT No.: PCT/DE2018/100031
§ 371 (c)(1),
(2) Date: Aug. 21, 2018

(87) PCT Pub. No.: WO2018/166551
PCT Pub. Date: Sep. 20, 2018

(65) Prior Publication Data

US 2021/0046751 A1 Feb. 18, 2021

(30) Foreign Application Priority Data

Mar. 16, 2017 (DE) ..... 10 2017 105 704.8

(51) Int. Cl.
*B41F 33/00* (2006.01)

(52) U.S. Cl.
CPC ..... *B41F 33/0027* (2013.01); *B41F 33/0036* (2013.01)

(58) Field of Classification Search
CPC .. B41F 33/0036; B41F 33/0027; B41F 33/00; B41F 5/20
See application file for complete search history.

(56) References Cited

U.S. PATENT DOCUMENTS 7,650,019 B2 * 1/2010 Turke ..... H04N 1/0035 382/112

FOREIGN PATENT DOCUMENTS

DE 102006050274 A1 5/2008
DE 102008059759 A1 6/2010
(Continued)

OTHER PUBLICATIONS

International Search Report and Written Opinion issued in PCT/DE2018/100031, dated Apr. 17, 2018; ISA/EP.

*Primary Examiner* — Leslie J Evanisko
*Assistant Examiner* — Leo T Hinze
(74) *Attorney, Agent, or Firm* — Harness, Dickey & Pierce, P.L.C.

(57) ABSTRACT

The invention relates to a method for verifying a printing plate, specifically a gravure cylinder, for errors in an engraving of the printing plate, comprising the following steps: Generating at least two proofs using a printing plate to be verified, capturing at least one digital image each of the at least two proofs with an image-capturing unit, comparing each of the digital images of the at least two proofs with the engraving template of the printing plate, wherein the comparison comprises the following steps: Detecting deviations between each of the images and the engraving template, and verifying that the detected deviations occur in identical fashion on the digital images of all of the at least two proofs, wherein a pseudo error is indicated if the comparison does not show identical deviations between the digital images of the at least two proofs, and wherein identical deviations indicate an engraving defect in the printing plate.

10 Claims, 4 Drawing Sheets

(56) References Cited

FOREIGN PATENT DOCUMENTS

| | | | |
|---|---|---|---|
| EP | 1673226 | B1 | 3/2012 |
| WO | 2008049510 | A1 | 5/2008 |

* cited by examiner

METHOD FOR VERIFYING A PRINTING PLATE, SPECIFICALLY A GRAVURE CYLINDER

CROSS-REFERENCE TO RELATED APPLICATIONS

This application is a 371 U.S. National Stage of International Application No. PCT/DE2018/100031, filed on Jan. 17, 2018, which claims priority to German Application 102017105704.8, filed Mar. 16, 2017. The entire disclosures of the above applications are incorporated herein by reference.

FIELD

The invention is based on a method for verifying a printing plate, specifically a gravure cylinder, as known from EP 1 673 226 B1.

BACKGROUND

This section provides background information related to the present disclosure which is not necessarily prior art.

In the method known from the prior art, it is common to first generate a test print, or proof, which is compared with a corresponding template, for example, with a hard copy sample submitted to the print shop for the order to be printed, or with a corresponding graphics file. Any deviations detected between proof and template are then categorized according to various criteria and forwarded to an analyzing entity, which analyzes the deviations either mechanically or manually, and which classifies them as printing errors attributable to an engraving error on the printing plate, if applicable.

The disadvantage of the methods known from the prior art is that the proofs used for conducting the inspection of the printed image can at times display errors not attributable to defective areas on the printing plate but to other origins. For example, it is possible for ink blotches to occur during the printing process for creating a proof, due to improper application of ink or due to defective areas in the print medium (such as paper). Such so-called non-reproducible pseudo errors subsequently are erroneously considered during the analysis of the printing plate and thus lead to incorrect results. Another disadvantage of the method known from the prior art is that an original is compared with a proof of the completed print product, wherein all colors already are applied and mixed on the proof, such that it is impossible to inspect the quality of the individual ink applications.

SUMMARY

This section provides a general summary of the disclosure, and is not a comprehensive disclosure of its full scope or all of its features.

The object of the invention therefore is to further develop a method for verifying a printing plate for printing, such that the method is highly accurate and specifically such that it allows for the reliable elimination of pseudo errors.

Accordingly, the method comprises the following steps:

generating at least two proofs using a printing plate to be verified;

capturing at least one digital image each of the at least two proofs, using an image-capturing unit;

comparing each of the digital images of the at least two proofs with the engraving template of the printing plate, wherein the comparison comprises the following steps:

detecting deviations between each of the images and the engraving template, and verifying that the detected deviations occur in identical fashion on the digital images of all of the at least two proofs, wherein a pseudo error is indicated if the comparison does not show identical deviations between the digital images of the at least two proofs, and wherein identical deviations indicate an engraving defect in the printing plate.

The image capturing unit can be an optical scanner, for example.

Generating at least two proofs may include generating respective monochrome prints from the printing plate. The ink used for the monochrome print essentially may be any monochrome ink and is not required to be a specific color ink, as long as it provides sufficient contrast in relation to the print substrate. If the printing plate is intended for prints in the CMYK color space, the prints could be made using one of the colors cyan, magenta, yellow and black, for example.

An engraving file of the printing plate or a reference image of the surface of the engraved printing plate can be used as an engraving template for the comparison of the digital images. For example, the original could be an engraving file, which was the basis for the production of the printing cylinder.

While comparing the engraving template and the images, identical image positions of the respective image and the engraving template can be contrasted, wherein deviations at each image position are determined by reviewing whether the differences between the engraving template and the image with regards to defined optical parameters, specifically brightness, adhere to a respective tolerance range. Other conceivable test parameters could be saturation and/or hue, wherein these are particularly suitable for differentiating between printing substrate and printing image point.

In this context, deviations can be assumed to be corresponding, if one of the detected deviations is found in the same image position on all images, on the one hand, and the detected differential values lie within a defined tolerance range, on the other.

Prior to comparing the digital images with the engraving template, image points can be identified on each of the images, which are associated with the respective corresponding image points on the template.

The identification of corresponding image points between the digital images and the engraving template may include the allocation of those image points, which show the greatest match strength, to a point pair, wherein each point pair is formed by an image point of one of the images and an associated image point of the engraving template.

For each point pair, a comparison can be drawn between a brightness level of the image point of the image and a brightness level of the image point of the engraving template, wherein these brightness values subsequently can be brought closer to each other and preferably be matched.

The generation of at least two proofs may comprise printing onto a substrate, specifically onto paper, using the printing plate, wherein the finding during the verification process of identical deviations between the digital images of the at least two proofs will continue to exclude the presence of a substrate defect.

It is advantageous for the image capture unit to generate the images in a digital format. Accordingly, the images can be provided as image files, which can be processed with commonly available image processing software. Accordingly, a computer-based image processing unit can be used to detect the deviations.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

The invention will be explained in more detail in the following by means of the exemplary embodiments shown in the following drawings. These show:

DETAILED DESCRIPTION

Figure 1:
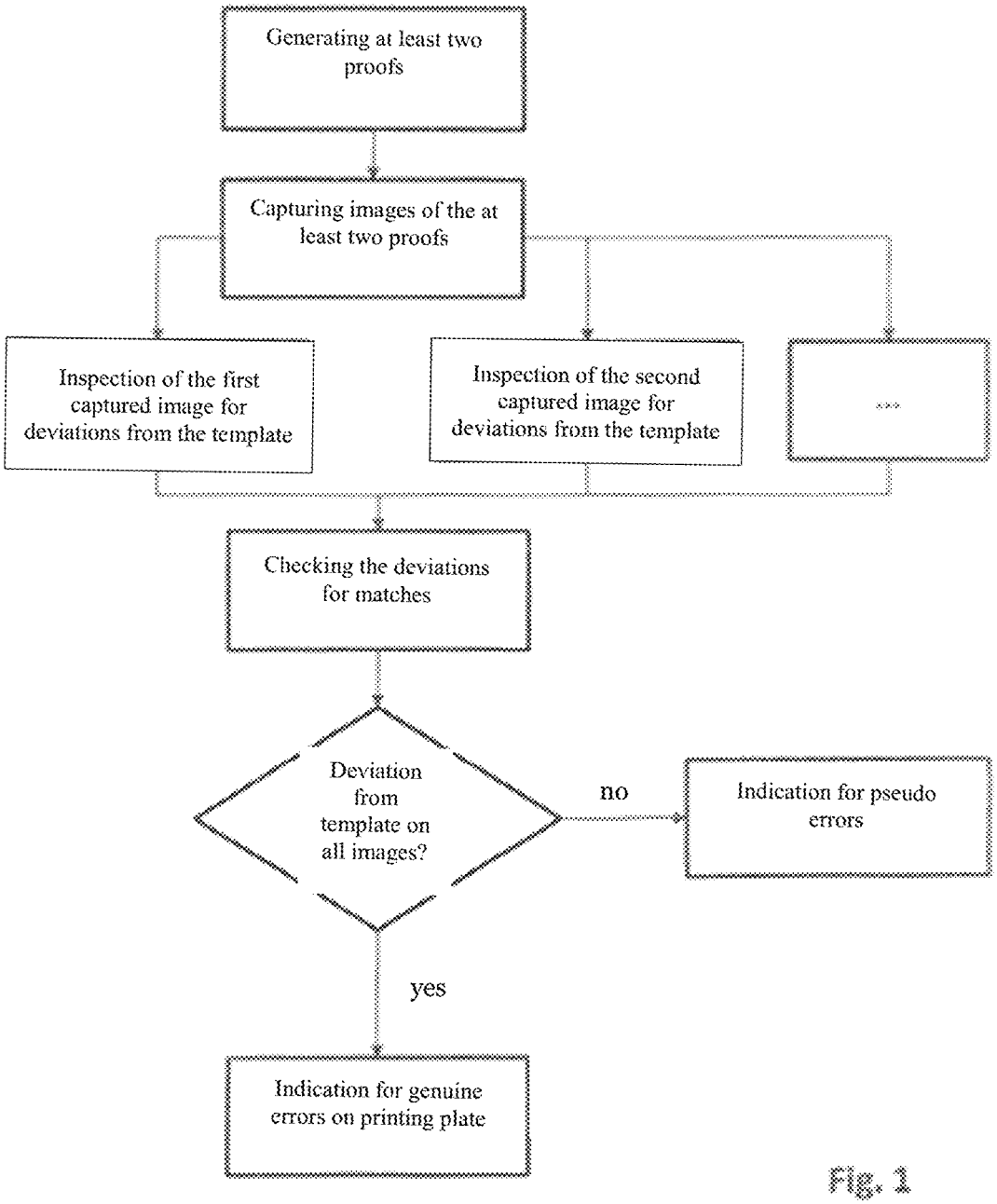
FIG. 1 shows a diagram of a process sequence for verifying a printing plate according to one embodiment of the invention.

Example embodiments will now be described more fully with reference to the accompanying drawings.

Due to high quality requirements in modern packaging applications such as plastic foils or beverage cartons, high aesthetic demands must be met. Furthermore, texts, warning symbols and bar codes must be highly legible. In order to verify the respective printing plates, proofs are compared to an error-free reference, also called a golden template, for which, according to the invention, the engraving template of the printing plate is used. At least two proofs from the printing plate are contrasted with the reference and inspected for deviations compared to the same. Possible errors may specifically include visually noticeable errors such as dents, scratches, inclusions, splatters, runs, offsets, smears, overly intense, weak or missing print, or color errors. Color errors include discoloration, color fades and color deviations from the target sample. In order to compare the proofs, they must first be optically captured, for example, scanned, whereby a digital image of at least two proofs is generated. The comparison of the digital images with the reference and, if applicable, the prior preparation of the digital images to improve the measurement results (brightness adjustment, contrast alignment, etc.) may be conducted with the help of commonly used, computer-based image processing procedures.

Traditionally, a proof is a test print using a printing matrix newly set up or produced for a new motif. In this context, the print is made on the same print medium and with the same inks as are used in the final application. In the sense of the methods for printing image inspection known from the prior art, "complete" prints are used as proofs, in which all color inks have already been applied and which already show the complete motif to be created.

As shown in the drawings, two proofs are generated per printing plate in the present invention. As a separate printing plate is provided for each color in multicolor prints using the rotogravure process, it follows that two proofs can be produced for each printing plates used and thus for each color printed (for example, cyan, magenta, yellow and black in CMYK print).

In this color-selective quality control, significantly smaller imperfections can be found compared to the traditional procedure, as the different color inks are not layered on top of one another at this point, which could lead to one color possibly hiding imperfections in other colors. The generation of two proofs from each respective cylinder furthermore is intended to prevent that errors are considered in the subsequent error analysis, which only are present on one of the proofs and therefore cannot be attributed to an engraving error of the respective printing plate. These errors most likely are mere flaws in the printing process, which cannot be attributed to poorly executed or damaged engraving of the printing plate.

In a first step, two or more proofs are generated on a substrate such as a roll of paper from the printing plate to be verified. The printing plate specifically may be a gravure cylinder, although it is not limited to such embodiments. As each respective gravure cylinder is provided for printing a single color, the proofs thus produced therefore also can be monochromatic.

Subsequently, the proofs are copied via an image-capturing unit such as a commonly available optical scanner, such that the proofs are then available in a digital format, particularly in a file format commonly used for image processing and image analysis.

Following this step, the digital images 1, 2 of the proofs are analyzed for deviations from a template 3, wherein each digital image 1, 2 is individually compared with the template 3. The template 3 is a target representation of the printed image to be produced and therefore includes no errors. It can be a sample of the desired printed image, as submitted to the print shop by the customer, for example. However, it is preferable to use a graphics file as a template. Specifically, the template can be the engraving template, on which the engraving of the respective gravure cylinder was based. The advantage of this secondary use of the engraving template is that it saves the effort and costs of generating a template solely for the purpose of verifying the printing plate. Additionally, this eliminates transfer errors, which could occur during the synthesis and generation of the template from the graphics file.

To compare each digital image 1, 2 with the template 3, each image position of each image 1, 2 is contrasted with the respective image position of the template 3. In this context, differences in various, previously defined optical parameters are captured as deviations. The differences can either be calculated between each contrasted pair of image points or be calculated as averages of larger pixel clusters, wherein each respective pixel cluster ideally represents specific image characteristics. The optical parameters specifically could be the brightness, saturation and hue of the respective image point or pixel cluster. Such detected deviations are classified as errors if the respective calculated differences exceed a previously defined threshold value. Subsequent to the respective inspection of the images 1, 2 for deviations from the template 3, an analysis of the images 1, 2 is performed to determine whether the detected deviations from the template are identical in the two images 1, 2. In the case of a flaw on the surface profile of the gravure cylinder, a corresponding error would have to be visible in the exact same position on both images 1, 2. If the comparing inspection of the two images 1, 2 comes to the result that a deviation is present on each of the inspected images 1, 2, the identical deviations are then forwarded to an analysis unit for further error analysis.

The determination of "identical deviations" can be designated for cases in which the respective deviation is found in the same image position on all images 1, 2, on the one hand, and the differences between the detected differential values of the individual images 1, 2 lie within a defined tolerance range, on the other. But if the contrasting inspection determines that a deviation from the template 3 is not present on both images 1, 2, this error is classified as pseudo error and is not forwarded to the analyzing unit, such that this unit is not impacted by the needless processing of pseudo errors.

Pseudo errors 4 could, for example, result from paper defects or ink blotches 25 and therefore are not attributable to flaws in the engraving of the gravure cylinder. It therefore is desirable to identity pseudo errors 4 prior to a further, time-consuming analysis and to exclude such errors from the verification.

In order to also be able to eliminate the image-capturing unit as a source of errors, it can be advantageous to capture the different images 1, 2 with different scanners or image-capturing units. This would prevent, for example, that contamination on the scanner could lead to supposed errors on all captured images and that these errors could pass the aforementioned verification of pseudo errors without detection.

In order to enable an error comparison between the images 1, 2 and the template 3, the captured images 1, 2 can first be aligned with the template 3. To do this, identical or at least partially identical motifs must be recognized in the images 1, 2 and the template 3, and the respective corresponding image areas must be associated with each other. To do this, a transformation of the images 1, 2 onto the template 3 may be conducted via so-called feature points. To do this, both the scanned image 1, 2 and the template 3 must be inspected pixel by pixel for continuous image features. Features are grouped according to various criteria in this context. However, the boundaries or the edges of a feature usually are found in image areas with high gradients between pixels with regards to their color or brightness levels. If the image processing unit identifies a deviation from the template 3 or a flaw in the image 1, 2, which comprises several adjacent pixels that are differentiated from their surroundings by a certain characteristic, this deviation also is grouped into a feature.

The following step comprises an alignment between template 3 and image 1, 2, so as to associate certain features with each other. During this step, the features from the image 1, 2 are associated with the corresponding pixels of each corresponding feature of the reference file 3, such that point pairs are created. A so-called feature descriptor process is used to recognize the associated point pairs. An association of points with each other is conducted based on the inspection of which points show the greatest match strength with each other. In this context, the RANSAC algorithm is used to search for the best transformation to match the point pairs. RANSAC is an algorithm for estimating a model within a series of measurement value with outliers and gross errors, which especially is used for analyzing automated measurements, specifically in the area of machine vision, due to its robustness.

After the point pairs are determined, another transformation is performed, during which the difference in brightness levels is minimized. To find a more exact match between image 1, 2 and template 3, an improved, enhanced transformation based on the transformation determined during the previous step is pursued. Further transformations are performed to smooth distortions in the image 1, 2 of the proof and to adapt them to the alignment of the template 3. This process is conducted in two steps, by first performing a global transformation of the entire proof, followed by a local transformation of smaller partial areas of the proof. Subsequently, the difference in brightness levels of the two images is minimized, by adjusting the brightness of the pixels in the image 1, 2 to those in the template 3 on the basis of the detected difference in brightness levels of the individual pixels of the point pairs. To adjust the brightness, the respective brightness areas of the template 3 are adjusted to those of the corresponding areas in the image 1, 2.

For this purpose, brightness areas are defined, which comprise pixels with similar brightness levels. Subsequently, for each brightness area of the reference image, or the template 3, the brightness levels are adjusted in the corresponding area of the image 1, 2. In this context, the brightness is adjusted with the aid of the standard deviation and mean of the brightness levels of the area, wherein each pixel has a brightness level. Levels showing too high a deviation from the mean brightness are not considered in this and are not included in the calculation. Such a brightness adjustment makes it possible to adjust the images 1, 2 without overly manipulating potential errors to the point where these could no longer be detected.

The difference between template 3 and the adjusted scanned image 1, 2 is calculated during the subsequent error detection. Areas, in which the calculation results in a large difference between brightness levels, now stand out as possible places for potential errors in the proof. However, these resulting deviations or anomalies only are forwarded to the subsequent analyzing unit, firstly, if the respective differences in brightness are above certain previously defined threshold values and secondly, if the potential errors are present in both images 1, 2 or proofs. Through this process, pseudo errors 4 that result from ink blotches 25 or paper flaws 26 can be filtered out of the subsequent analysis used to verify the gravure cylinder.

Figure 2:
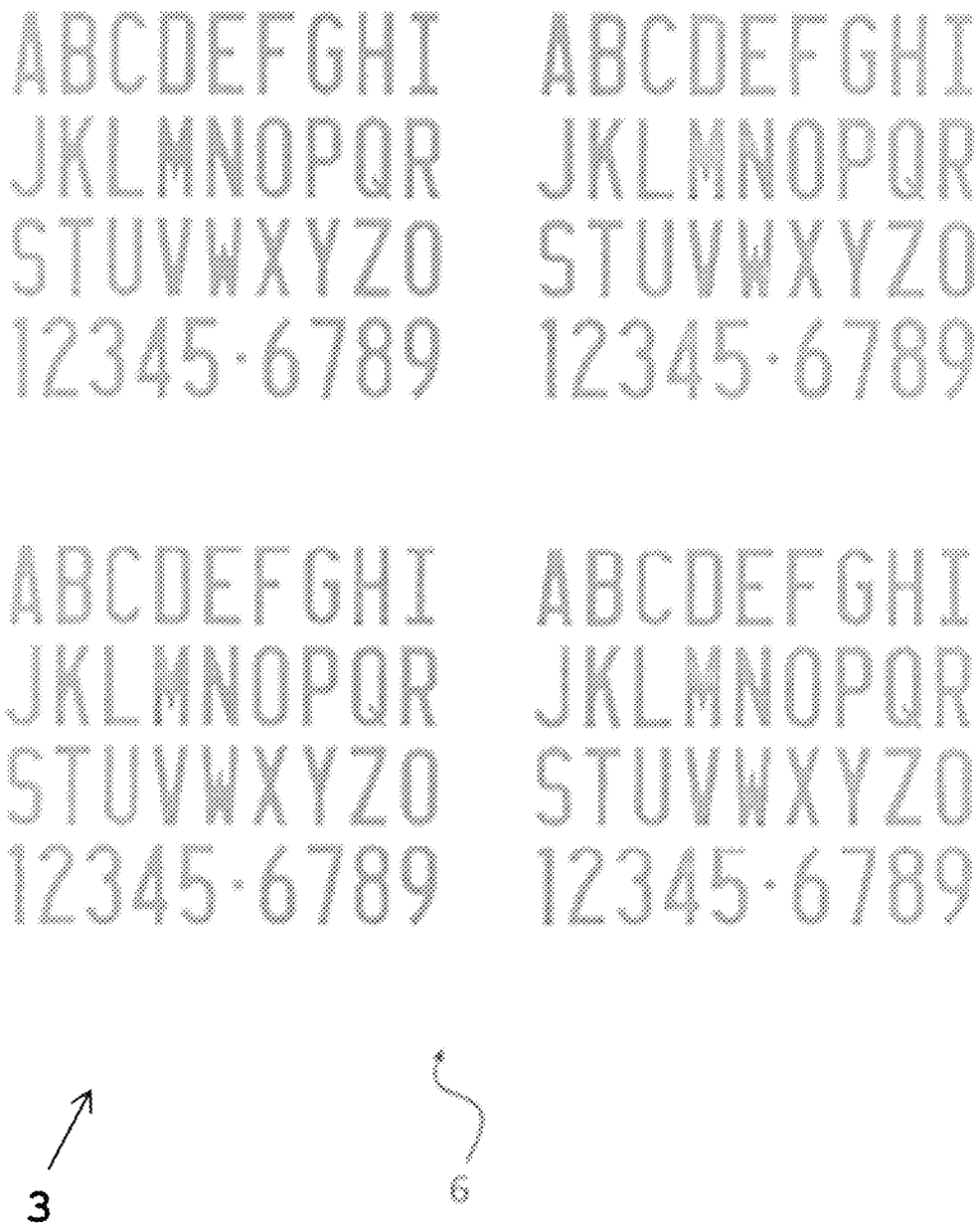
FIG. 2 shows an exemplary engraving template according to an embodiment of the invention.
Figure 3:
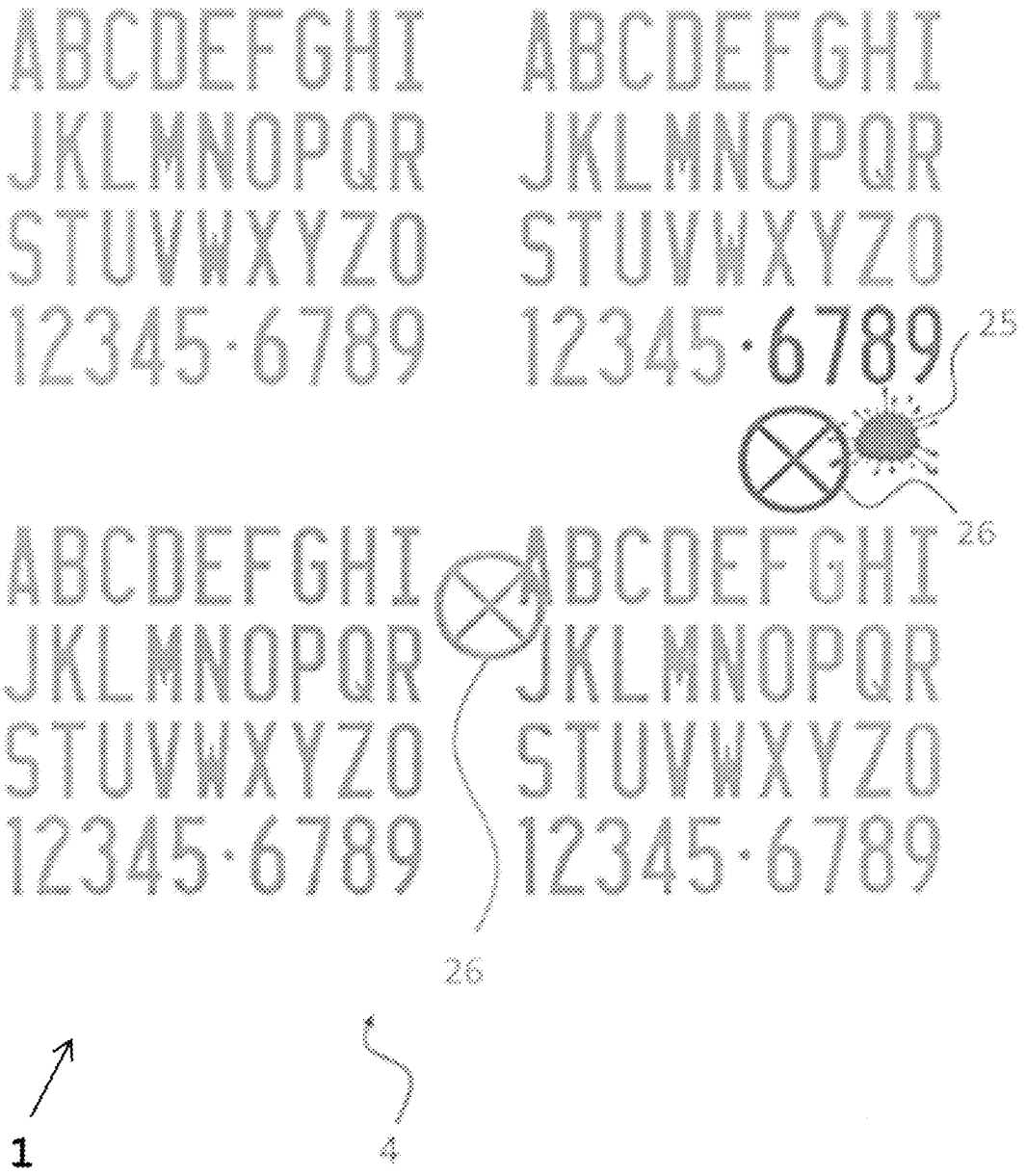
FIG. 3 shows a first proof from a printing plate generated according to the engraving template according to FIG. 2, with a first pseudo error.
Figure 4:
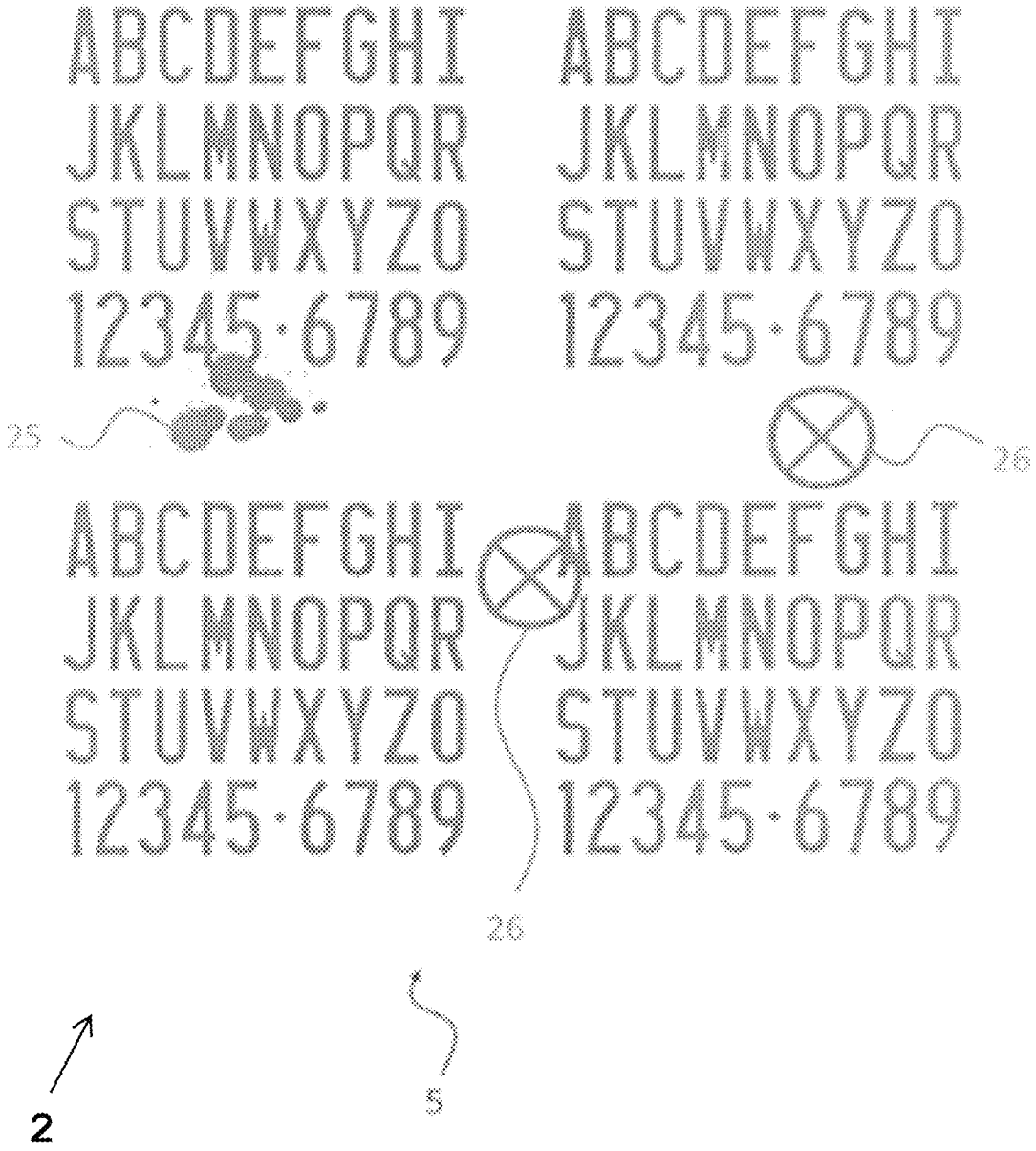
FIG. 4 shows a second proof from a printing plate generated according to the engraving template according to FIG. 2, with a second pseudo error.

FIGS. 2 to 4 include examples of a template 3 and two images 1, 2 of proofs, which include regular errors 5 in some portions and pseudo errors 4 in others. FIG. 2 additionally includes a template or reference file 3, which shows a graphic comprising four similar elements, each of which represents a print for a beverage carton and which are present on template 3 at regular intervals.

FIG. 3 shows a representation of an image 4 of a first proof of a printing plate, which also includes the same four similar elements as does the template 3, but which additionally includes a pseudo error 4 and two regular errors 5, which are distributed across the proof 1 and the captured image 4.

FIG. 4 shows another image 5 of another proof from the same printing plate. The image 5 also includes a pseudo error 4 and two regular errors 5. It is important to note that the pseudo error 4 is located in a different position than is the pseudo error on the first proof according to FIG. 3, and particularly that it differs in its physical shape.

During a first comparison of the images 1, 2 with the template 3, both the regular errors 5 and the respective pseudo errors 4 are detected, without any differentiation being made between them initially. During the subsequent comparison of the two images 1, 2 with each other, each of the errors 4, 5 of each image 1, 2 are compared with the template 3 to verify if each respective error also is present on the respective other image 1, 2.

Both errors 5 can be classified as regular/genuine errors of the printing plate due to their shape and their position on the images 1, 2. No error can be found on FIG. 4 that corresponds to the pseudo error 4 from FIG. 3, and conversely no corresponding pseudo error 4 on FIG. 3 matches the pseudo error 4 from FIG. 4. Because these (pseudo) errors 4 only occur once, they are classified as irrelevant for the subsequent analytic process, such that the pseudo errors 4 are not subject to any further inspection, thereby simplifying the quality inspection of the printing plate.

Even if the pseudo errors 4 were displayed in a similar or identical image position in the example shown, they still differed in their geometric shape, which means that the errors 4 would still be recognized as pseudo errors in this case. Conversely, the same applies if two errors of the same geometric shape were located in different image positions in the images 1, 2. These errors would also be recognized as pseudo errors in such a case.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A method for verifying a printing plate, specifically a gravure cylinder, for errors in an engraving of the printing plate, comprising:

generating at least two proofs using the printing plate to be verified, capturing at least one digital image of each of the at least two proofs, using an image-capturing unit, comparing each of the digital images of the at least two proofs with an engraving template of the printing plate to generate a comparison, wherein the comparison includes:

detecting deviations between each of the digital images and the engraving template, and verifying that the detected deviations occur in identical fashion on the digital images of all of the at least two proofs, wherein a pseudo error is indicated if the comparison does not show identical deviations between the digital images of the at least two proofs, and wherein identical deviations indicate an engraving defect in the printing plate.

2. The method according to claim 1, wherein the generation of at least two proofs includes the generation of a respective monochrome print of the printing plate.

3. The method according to claim 1, wherein an engraving file of the printing plate or a reference image of the surface of the engraved printing plate is used as the engraving template for comparing the digital images.

4. The method according to claim 1, wherein identical image positions of the digital images of the at least two proofs and the engraving template are contrasted while comparing the engraving template and the digital images of the at least two proofs, wherein detected deviations at each image position are determined by reviewing whether there are any differences between the engraving template and the digital images of the at least two proofs with regards to defined optical parameters, specifically brightness, adhere to a respective tolerance range.

5. The method according to claim 4, wherein deviations are assumed to be corresponding if one of the detected deviations is found in the same image position on all digital images of the at least two proofs, on the one hand, and detected differential values lie within a defined tolerance range, on the other.

6. The method according to claim 1, wherein prior to comparing the digital images of the at least two proofs with the engraving template, image points are identified on each of the digital images of the at least two proofs, which are associated with the corresponding image points on the engraving template.

7. The method according to claim 6, wherein the identification of corresponding image points between the digital images of the at least two proofs and the engraving template includes a joint allocation of those image points, which show a greatest match strength with each other, to a point pair, wherein each point pair is formed by an image point of one of the digital images of the at least two proofs and an associated image point of the engraving template.

8. The method according to claim 7, wherein a comparison is drawn between a brightness value of the image point of the digital images of the at least two proofs and a brightness value of the image point of the engraving template for each point pair, wherein these brightness values subsequently are brought closer to each other and preferably are matched.

9. The method according to claim 7, wherein for each point pair, the engraving template and the digital images of the at least two proofs are displayed next to each other or on top of each other on a visual display, wherein two image points of the point pair are visually associated with each other, and specifically are connected with each other by a line.

10. The method according to claim 1, wherein the generation of at least two proofs comprises printing onto a substrate, specifically onto paper, using the printing plate, wherein the verifying of identical deviations between the digital images of the at least two proofs will continue to exclude a presence of a substrate defect.

* * * * *